US012349807B2

(12) United States Patent
Chen et al.

(10) Patent No.: US 12,349,807 B2
(45) Date of Patent: Jul. 8, 2025

(54) LEISURE ROTARY SWING CHAIR

(71) Applicant: Yotrio Group Co., Ltd., Linhai (CN)

(72) Inventors: Jie Chen, Linhai (CN); Jianqiang Xie, Linhai (CN)

(73) Assignee: Yotrio Group Co., Ltd., Lin Hai (CN)

( * ) Notice: Subject to any disclaimer, the term of this patent is extended or adjusted under 35 U.S.C. 154(b) by 188 days.

(21) Appl. No.: 18/220,263

(22) Filed: Jul. 10, 2023

(65) Prior Publication Data

US 2024/0285079 A1 Aug. 29, 2024

(30) Foreign Application Priority Data

Feb. 24, 2023 (CN) ..... 202320304089.5

(51) Int. Cl.
*A47C 3/025* (2006.01)
*A47C 3/026* (2006.01)
*A47C 3/18* (2006.01)

(52) U.S. Cl.
CPC ..... *A47C 3/0257* (2013.01); *A47C 3/026* (2013.01); *A47C 3/18* (2013.01)

(58) Field of Classification Search
CPC ..... A47C 3/0257; A47C 3/18; A47C 3/026
USPC ..... 297/344.21, 344.26, 344.24
See application file for complete search history.

(56) References Cited

U.S. PATENT DOCUMENTS 108,255 A * 10/1870 Grawitz ..... A47C 3/027 297/263.1
116,571 A * 7/1871 Doubler ..... A47C 3/027 297/263.1
673,578 A * 5/1901 Johnson ..... A47C 9/002 297/344.21
5,048,893 A * 9/1991 Cowan ..... A47C 3/0257 297/313
8,672,406 B2 * 3/2014 Ross ..... A47C 1/14 297/344.13
10,638,844 B2 * 5/2020 Shih ..... A47C 3/0251

FOREIGN PATENT DOCUMENTS

EP 3925489 A1 * 12/2021 ..... A47C 3/0257

* cited by examiner

*Primary Examiner* — Milton Nelson, Jr.
(74) *Attorney, Agent, or Firm* — Jingming Cai (James); SAC Attorneys LLP

(57) ABSTRACT

A leisure rotary swing chair including a chair frame, a base, a rotary assembly, a chute assembly, and a sliding rail assembly is provided. The base is connected to a bottom part of the chair frame to support the chair frame. The rotary assembly is rotatably connected to the base. The rotary assembly includes a fixed frame that rotates about the base and facilitates rotation of the chair frame. The chute assembly is disposed on the fixed frame of the rotary assembly. The sliding rail assembly is operably coupled to the chute assembly and disposed in the bottom part of the chair frame. The sliding rail assembly slides in the chute assembly to swing the chair frame back and forth.

8 Claims, 4 Drawing Sheets

LEISURE ROTARY SWING CHAIR

CROSS-REFERENCE TO RELATED APPLICATIONS

This application claims priority to and the benefit of the patent application titled "A leisure rotary swing chair", application 2023203040895, filed in the China National Intellectual Property Administration on Feb. 24, 2023. The specification of the above-referenced patent application is incorporated herein by reference in its entirety.

FIELD OF THE INVENTION

The present invention, in general, relates to leisure chairs, and in particular, relates to a leisure rotary swing chair.

BACKGROUND

Leisure chairs are typically used outdoors, for example, in courtyards and other outdoor locations, by users to rest. Conventional outdoor leisure chairs belong to a single category, have a singular function, provide insufficient comfort, and do not provide users with different experiences.

Hence, there is a need for a leisure rotary swing chair with an optimized structure and a swing type design that makes the chair swing back and forth and provides users with different swing experiences.

SUMMARY OF THE INVENTION

To address the above-recited problems, the present invention provides a leisure rotary swing chair. The leisure rotary swing chair comprises a chair frame, a base, a rotary assembly, a chute assembly, and a sliding rail assembly. The base is connected to a bottom part of the chair frame to support the chair frame. The rotary assembly is rotatably connected to the base. The rotary assembly comprises a fixed frame configured to rotate about the base and facilitate rotation of the chair frame. The chute assembly is disposed on the fixed frame of the rotary assembly. The sliding rail assembly is operably coupled to the chute assembly and is disposed in the bottom part of the chair frame. The sliding rail assembly is configured to slide in the chute assembly to swing the chair frame back and forth. The cooperation between the fixed frame of the rotary assembly and the base during rotation realizes the rotation of the chair frame.

In an embodiment, the base comprises an underframe, a sleeve, and multiple stiffeners. The sleeve is disposed above the underframe. The stiffeners are disposed between the underframe and the sleeve. The stiffeners are configured to center around the sleeve and extend radially from the sleeve. The stiffeners are configured to bend upwardly from the underframe to the sleeve. An upper end of each of the stiffeners is connected to a side wall of the sleeve, and a lower end of each of the stiffeners is connected to the underframe, which ensures that a lower end of the sleeve is positioned higher than the underframe, thereby providing a height space for the chair frame to swing back and forth.

In an embodiment, the rotary assembly further comprises a rotating shaft extending from a bottom surface of the fixed frame. The rotating shaft is sleeved in the sleeve of the base to rotate in the sleeve.

In an embodiment, the leisure rotary swing chair further comprises a buffer ring disposed on an upper end of the sleeve of the base. The buffer ring cushions contact surfaces of the sleeve and the fixed frame of the rotary assembly, thereby reducing friction therebetween.

In an embodiment, the chute assembly comprises a mounting frame disposed on the fixed frame of the rotary assembly. The chute assembly further comprises one or more chutes. Both ends of the chute(s) are fixed to the mounting frame using bolts. In an embodiment, the chute assembly further comprises one or more groups of chutes.

In an embodiment, the sliding rail assembly comprises one or more arc-shaped frames depressing downward, and a guide rail pipe. The arc-shaped frame(s) extends downwardly into the bottom part of the chair frame. Both ends of the arc-shaped frame(s) are respectively fixed to a front frame and a rear frame of the bottom part of the chair frame. The guide rail pipe is disposed on a bottom part of the arc-shaped frame(s). The guide rail pipe is configured to be in a sliding fit connection to the chute(s) of the chute assembly.

In an embodiment, the sliding rail assembly further comprises a stopper disposed on a bottom part of two ends of the guide rail pipe.

In an embodiment, the arc-shaped frame(s) of the sliding rail assembly is a V-shaped groove. In another embodiment, the arc-shaped frame(s) is a U-shaped groove. The V-shaped groove or the U-shaped groove comprises a notch configured to extend horizontally outward to form an extended board. The guide rail pipe is fixed to a bottom part of the V-shaped groove or the U-shaped groove.

In an embodiment, the underframe of the base is a circular frame. In this embodiment, four stiffeners extend uniformly radially from the sleeve disposed above a center of the circular frame. The upper end of each of the four stiffeners is connected to the side wall of the sleeve, and the lower end of each of the four stiffeners is connected to the circular frame.

In the present invention, the arrangement of the rotary assembly, the chute assembly, and the sliding rail assembly between the chair frame and the base allows the leisure rotary swing chair to rotate and swing back and forth like a swing while maintaining the basic functions of a chair. The leisure rotary swing chair has a simplified structure and meets diversified needs of users.

In the figures: 100—leisure rotary swing chair, 1—chair frame, 11—upper seat frame, 12—lower movable frame, 13—seat cushion holder, 2—base, 21—underframe, 22—stiffener, 23—sleeve, 24—buffer ring, 3—rotary assembly, 31—fixed frame, 32—rotating shaft, 4—chute assembly, 41—mounting frame, 42—chutes, 43—bolts, 5—sliding rail assembly, 51—arc-shaped frame, 52—guide rail pipe, and 53—stopper.

DETAILED DESCRIPTION OF THE INVENTION

A leisure rotary swing chair of the present invention is further described below with reference to the drawings.

Figure 1:
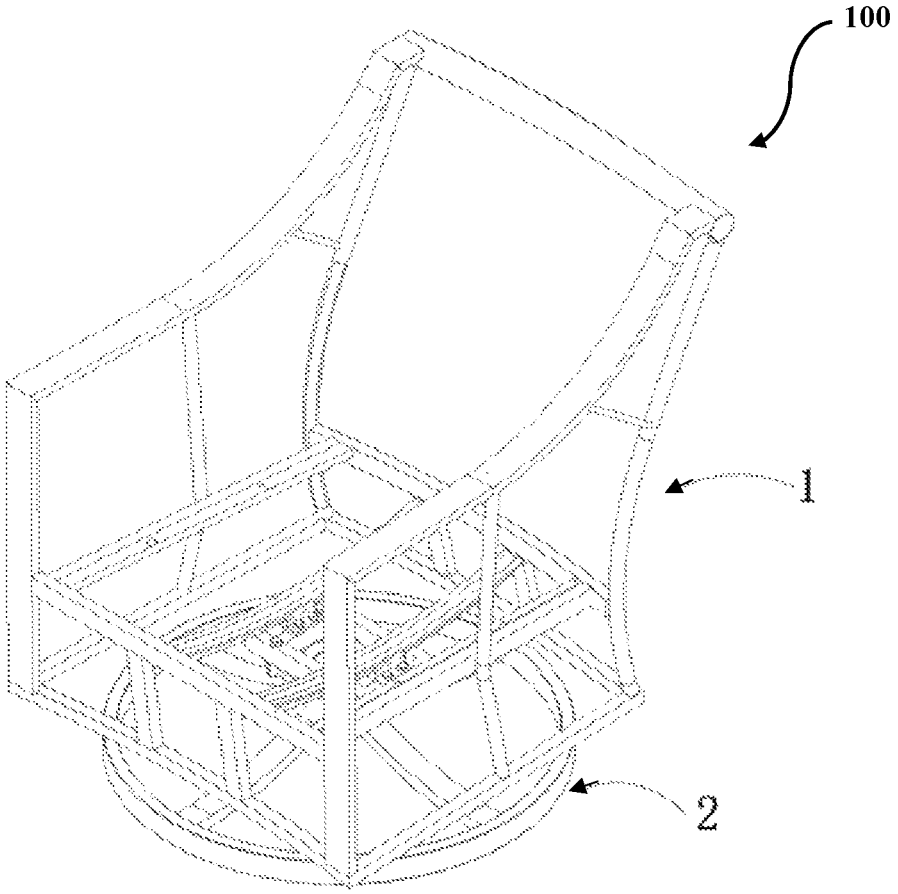
FIG. 1 is a structural diagram of a leisure rotary swing chair.
Figure 2:
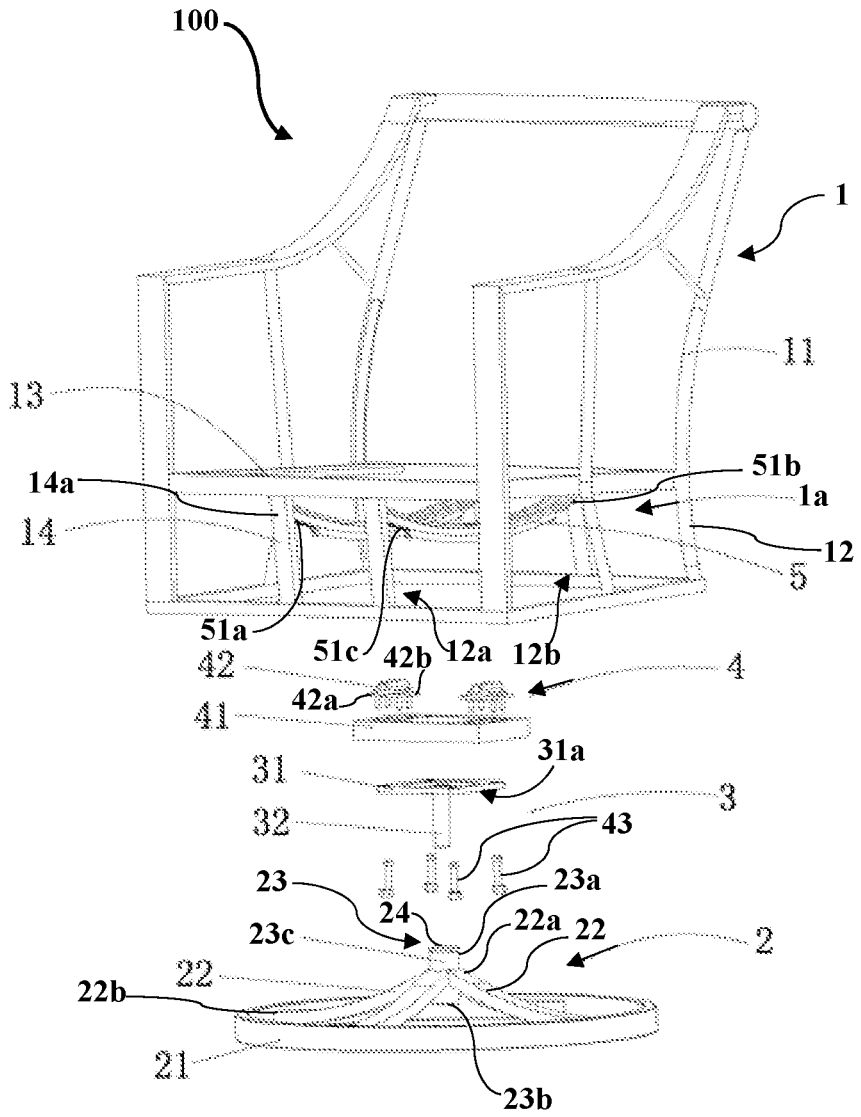
FIG. 2 is an exploded structural view of the leisure rotary swing chair.

As shown in FIG. 1 and FIG. 2, the leisure rotary swing chair 100 comprises a chair frame 1, a base 2, a rotary assembly 3, a chute assembly 4, and a sliding rail assembly 5. The base 2 is connected to a bottom part 1*a* of the chair frame 1 to support the chair frame 1. The rotary assembly 3 is rotatably connected to the base 2. The chute assembly 4 is disposed on the rotary assembly 3. The sliding rail assembly 5 is operably coupled to the chute assembly 4 and disposed in the bottom part 1*a* of the chair frame 1. The sliding rail assembly 5 is configured to match and communicate with the chute assembly 4. The rotary assembly 3 drives the chair frame 1 to rotate. The movement of the sliding rail assembly 5 in the chute assembly 4 drives the chair frame 1 to swing back and forth.

The base 2 of the leisure rotary swing chair 100 comprises an underframe 21, a sleeve 23, and multiple stiffeners 22. The sleeve 23 is disposed above a center of the underframe 21. The stiffeners 22 are disposed between the underframe 21 and the sleeve 23. The stiffeners 22 are arranged to center around the sleeve 23 and extend radially from the sleeve 23. The stiffeners 22 are configured to bend upwardly from the underframe 21 to the sleeve 23. An upper end 22*a* of each of the stiffeners 22 is connected to a side wall 23*c* of the sleeve 23, and a lower end 22*b* of each of the stiffeners 22 is connected to the underframe 21, as shown in FIG. 2, which ensures that a lower end 23*b* of the sleeve 23 is positioned higher than the underframe 21, thereby providing a height space for the chair frame 1 to swing back and forth. In an embodiment, the underframe 21 is a circular frame as shown in FIGS. 1-2. In this embodiment, four stiffeners 22 extend uniformly radially from the sleeve 23 disposed above a center of the circular frame as shown in FIG. 2. The upper end 22*a* of each of the four stiffeners 22 is connected to the side wall 23*c* of the sleeve 23, and the lower end 22*b* of each of the four stiffeners 22 is connected to the circular frame.

The rotary assembly 3 comprises a fixed frame 31 as shown in FIG. 2. The fixed frame 31 of the rotary assembly 3 is configured to rotate about the base 2 and facilitate rotation of the chair frame 1. The rotary assembly 3 further comprises a rotating shaft 32 extending from a bottom surface 31*a* of the fixed frame 31. The rotating shaft 32 is sleeved in the sleeve 23 of the base 2 to rotate in the sleeve 23. In an embodiment, the leisure rotary swing chair 100 further comprises a buffer ring 24 disposed on an upper end 23*a* of the sleeve 23 for cushioning contact surfaces of the sleeve 23 and the fixed frame 31, thereby reducing friction therebetween.

The chute assembly 4 is disposed on the fixed frame 31 of the rotary assembly 3. The chute assembly 4 comprises a mounting frame 41 and one or more chutes 42, for example, two chutes 42, as shown in FIG. 2. In an embodiment, the chute assembly 4 comprises one or more groups of chutes 42. The mounting frame 41 is disposed on the fixed frame 31. Both ends 42*a* and 42*b* of each of the chutes 42 are fixed to the mounting frame 41 using bolts 43.

Figure 3:
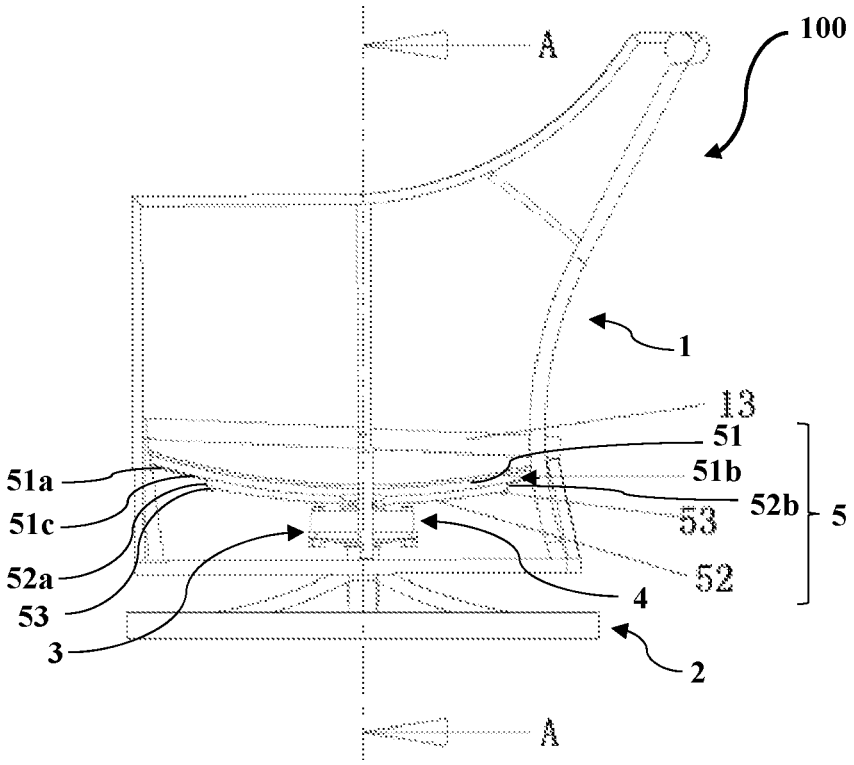
FIG. 3 is a side view of the leisure rotary swing chair.
Figure 4:
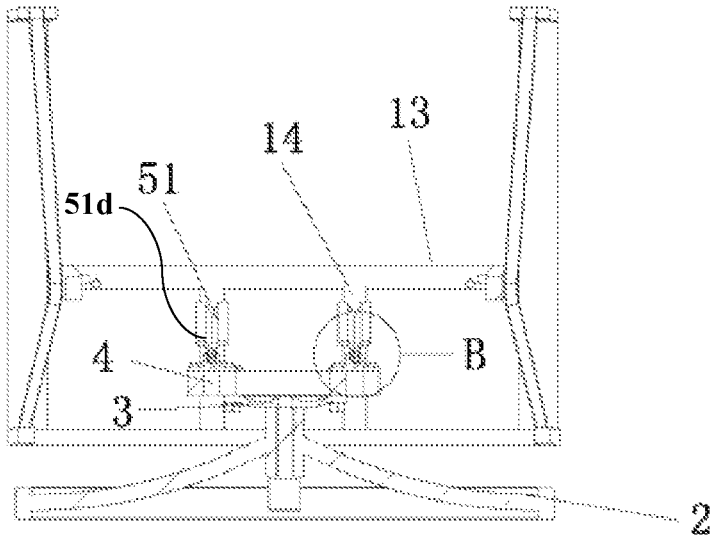
FIG. 4 is a sectional view of the leisure rotary swing chair, taken along a sectional line A-A shown in FIG. 3.
Figure 5:
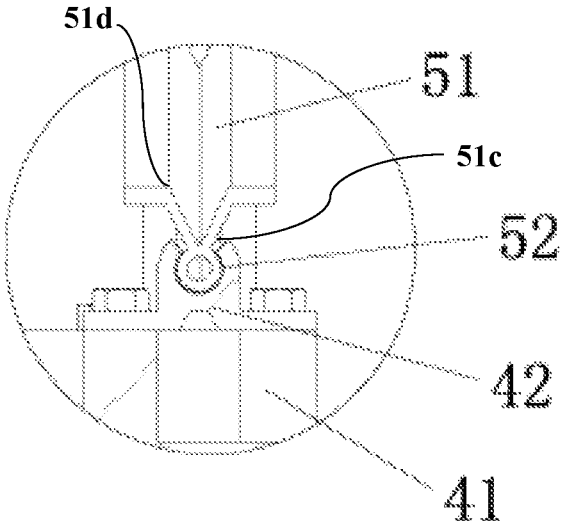
FIG. 5 is an enlarged view of a portion marked B in FIG. 4.

In an embodiment as shown in FIG. 2 to FIG. 4, the chair frame 1 is provided with a seat cushion holder 13. The seat cushion holder 13 divides the chair frame 1 into an upper seat frame 11 and a lower movable frame 12 as shown in FIG. 2. A front frame 12*a* and a rear frame 12*b* of the lower movable frame 12 are symmetrically provided with multiple vertical baffles 14. The number and position of the vertical baffles 14 on each of the front frame 12*a* and the rear frame 12*b* are identical to that of the chutes 42 of the chute assembly 4. The sliding rail assembly 5 is disposed between the symmetrical vertical baffles 14 of the front frame 12*a* and the rear frame 12*b*. The sliding rail assembly 5 is configured to slide in the chute assembly 4 to swing the chair frame 1 back and forth. The sliding rail assembly 5 comprises one or more arc-shaped frames, for example, two arc-shaped frames 51, depressing downward as shown in FIGS. 2-3. That is, the arc-shaped frames 51 extend downwardly from the seat cushion holder 13, into the bottom part 1*a* of the chair frame 1. Both ends 51*a* and 51*b* of each of the arc-shaped frames 51 are respectively fixed to an upper part 14*a* of two symmetrical vertical baffles 14 of the front frame 12*a* and the rear frame 12*b* of the lower movable frame 12, in the bottom part 1*a* of the chair frame 1. The sliding rail assembly 5 further comprises a guide rail pipe 52 disposed on a bottom part 51*c* of each of the arc-shaped frames 51. The guide rail pipes 52 are configured to be in a sliding fit connection to the chutes 42 of the chute assembly 4. That is, each guide rail pipe 52 is clamped into a corresponding chute 42 to be in a sliding fit connection to the chute 42. In an embodiment, the sliding rail assembly 5 further comprises a stopper 53 disposed on a bottom part of each of the two ends 52*a* and 52*b* of each guide rail pipe 52 for limiting the sliding scope of the guide rail pipe 52 within the chute 42 and ensuring that the guide rail pipe 52 moves in the chute 42. In an embodiment, each arc-shaped frame 51 is a V-shaped groove as shown in FIGS. 4-5. In another embodiment, each arc-shaped frame 51 is a U-shaped groove. The V-shaped groove or the U-shaped groove comprises a notch 51*d* configured to extend horizontally outward to form an extended board, thereby increasing the contact surface. The guide rail pipe 52 is fixed to the bottom part 51*c* of the V-shaped groove or the U-shaped groove as shown in FIG. 3 and FIG. 5.

In an embodiment, the mounting frame 41 of the chute assembly 4 is provided with two groups of chutes 42; correspondingly, the front frame 12*a* and the rear frame 12*b* of the bottom part 1*a* of the chair frame 1 are provided with two symmetrical vertical baffles 14, between which the sliding rail assembly 5 is arranged.

During installation, the chute assembly 4 is first fixed to the rotary assembly 3. The rotary assembly 3 with the affixed chute assembly 4 is then fixed to the base 2. The chair frame 1 is then mounted on the chute assembly 4 to complete the installation.

It shall be noted that the above embodiments have been provided only for illustrating the technical scheme of the present invention and not to limit the present invention. Although the present invention has been described with reference to the above embodiments, those ordinarily skilled in the art should understand that they can still modify the technical scheme recorded in the foregoing embodiments, or perform equivalent replacements on some or all of the technical features; however, such modifications or replacements do not separate the essence of technical schemes from the substance and scope of the technical schemes provided by the embodiments of the present invention.

We claim:

1. A rotary swing chair comprising:

a chair frame;

a base connected to a bottom part of the chair frame to support the chair frame, wherein the base comprises:

an underframe;

a sleeve disposed above the underframe; and a plurality of stiffeners disposed between the underframe and the sleeve wherein an upper end of each of the plurality of stiffeners is connected to a side wall of the sleeve, and a lower end of the each of the plurality of stiffeners is connected to the underframe;

a rotary assembly rotatably connected to the base, wherein the rotary assembly comprises a fixed frame configured to rotate about the base and facilitate rotation of the chair frame;

a chute assembly disposed on the fixed frame of the rotary assembly; and a sliding rail assembly operably coupled to the chute assembly and disposed in the bottom part of the chair frame, wherein the sliding rail assembly is configured to slide in the chute assembly to swing the chair frame back and forth.

2. The rotary swing chair according to claim 1, wherein the rotary assembly further comprises a rotating shaft extending from a bottom surface of the fixed frame, and wherein the rotating shaft is sleeved in the sleeve of the base to rotate in the sleeve.

3. The rotary swing chair according to claim 1, further comprising a buffer ring disposed on an upper end of the sleeve of the base.

4. The rotary swing chair according to claim 1, wherein the underframe of the base is a circular frame, wherein four stiffeners are configured to extend uniformly radially from the sleeve disposed above a center of the circular frame, wherein the upper end of each of the four stiffeners is connected to the side wall of the sleeve, and the lower end of the each of the four stiffeners is connected to the circular frame.

5. A rotary swing chair comprising:

a chair frame;

a base connected to a bottom part of the chair frame to support the chair frame;

a rotary assembly rotatably connected to the base, wherein the rotary assembly comprises a fixed frame configured to rotate about the base and facilitate rotation of the chair frame;

a chute assembly disposed on the fixed frame of the rotary assembly, wherein the chute assembly comprises:

a mounting frame disposed on the fixed frame of the rotary assembly; and one or more chutes, wherein both ends of each of the one or more chutes are fixed to the mounting frame using bolts; and a sliding rail assembly operably coupled to the chute assembly and disposed in the bottom part of the chair frame, wherein the sliding rail assembly is configured to slide in the chute assembly to swing the chair frame back and forth.

6. The rotary swing chair according to claim 5, wherein the sliding rail assembly comprises:

one or more arc-shaped frames extending downwardly into the bottom part of the chair frame, wherein both ends of each of the one or more arc-shaped frames are respectively fixed to a front frame and a rear frame of the bottom part of the chair frame; and a guide rail pipe disposed on a bottom part of each of the one or more arc-shaped frames, wherein the guide rail pipe is configured to be in a sliding fit connection to the each of the one or more chutes of the chute assembly.

7. The rotary swing chair according to claim 6, wherein the sliding rail assembly further comprises a stopper disposed on a bottom part of each of two ends of the guide rail pipe.

8. The rotary swing chair according to claim 6, wherein the each of the one or more arc-shaped frames of the sliding rail assembly is one of a V-shaped groove and a U-shaped groove, wherein the one of the V-shaped groove and the U-shaped groove comprises a notch configured to extend horizontally outward to form an extended board, and wherein the guide rail pipe is fixed to a bottom part of the one of the V-shaped groove and the U-shaped groove.

* * * * *